US006810619B2

(12) United States Patent
Wilson

(10) Patent No.: US 6,810,619 B2
(45) Date of Patent: Nov. 2, 2004

(54) LIGHT-BLOCKING SHUTTER SYSTEM

(76) Inventor: Ronald J. Wilson, 3156 W. Clarendon, Phoenix, AZ (US) 85017

( * ) Notice: Subject to any disclaimer, the term of this patent is extended or adjusted under 35 U.S.C. 154(b) by 0 days.

(21) Appl. No.: 10/196,625

(22) Filed: Jul. 15, 2002

(65) Prior Publication Data

US 2003/0009946 A1 Jan. 16, 2003

Related U.S. Application Data

(60) Provisional application No. 60/305,292, filed on Jul. 13, 2001.

(51) Int. Cl.[7] ..... E06B 7/08
(52) U.S. Cl. ..... 49/74.1
(58) Field of Search ..... 49/74.1, 87.1, 49/403

(56) References Cited

U.S. PATENT DOCUMENTS

| | | | | | |
|---|---|---|---|---|---|
| 103,854 | A | * | 6/1870 | Donato | 49/74.1 |
| 3,374,576 | A | * | 3/1968 | Duclon et al. | 49/81.1 |
| 3,742,648 | A | * | 7/1973 | Streeter, Jr. | 49/74.1 |
| 3,932,959 | A | * | 1/1976 | Jansons et al. | 49/74.1 |
| 5,020,276 | A | * | 6/1991 | Zittell | 49/87.1 |
| 6,401,391 | B2 | * | 6/2002 | Gabriele | 49/87.1 |

* cited by examiner

*Primary Examiner*—Jerry Redman
(74) *Attorney, Agent, or Firm*—Martin L. Stoneman

(57) ABSTRACT

An improved shutter and frame system for reducing light passing through and around a shutter. The system incorporates improved shutter manufacturing and a light blocking element along the sides of the louvers to block light from passing between the shutter frame and the louvers. The shutter utilizes a louver which never extends beyond the plane of the rear face of the shutter frame.

11 Claims, 8 Drawing Sheets

LIGHT-BLOCKING SHUTTER SYSTEM

CROSS-REFERENCE TO RELATED APPLICATION

The present application is related to applicant's prior U.S. Provisional Application No. 60/305,292, filed Jul. 13, 2001, entitled "LIGHT-BLOCKING SHUTTER SYSTEM", the contents of which are herein incorporated by reference and are not admitted to be prior art with respect to the present invention by their mention in this cross-reference section.

BACKGROUND

This invention relates to providing an improved shutter system for reduction of light emission into a building. Shutters generally utilizing pivoting louvers or slats for controlling the amount of light entering through a building light opening, such as a window or door, are well known (see, e.g., U.S. Pat. Nos. 4,974,362 and 5,020,276). Such louvers typically consist of a blade or wing construction with two thinner-edged, longer longitudinal sides, separated by a thicker middle portion between them and two shorter transverse ends.

Typically, such shutters have a plurality of such pivoting louvers connected to a rectangular frame. The frame typically consists of two side members referred to in the art as stiles and a top and bottom member referred to in the art as rails. The louvers are connected together by a tilt rod such that they may be moved in unison. The tilt rod is typically a U-cross-section wooden rod which has staples inserted into the flat portion of the rod, which are coupled to staples inserted into one surface of a longitudinal side of the louver. Typically, the tilt rod is inserted on the front face of the shutter, the front face of the shutter being defined herein as that portion of the shutter facing away from the outside light entry, such as through a window.

Such louvers are typically connected to the rectangular frame such that the longitudinal sides of the louvers are substantially horizontal or in line with the rails. Typically, the shutter is considered in a closed position when the tilt rod is in its most upward position and the louvers are slanted in a substantially vertical position slightly overlapping each other. The shutter is considered in a fully open position when the louvers are in a substantially horizontal position with no overlap. The louvers are adjustable and may be partially opened to allow varying amounts of light to pass through them.

The present invention relates generally to shutters in which the louvers are arranged such that the louvers never extend beyond the plane of the rear face of the frame (as referenced in U.S. Pat. No. 4,974,362), the rear face of the shutter being defined herein as the face opposing the front face. One of the problems with prior art shutters is that light penetrates through and around the shutter even when closed. One of these areas subject to such penetration is the area between the louver and the shutter frame. Another area that light penetrates through and around is along the side of a shutter such as when a shutter is covering a French door window. Yet another area of light penetration is in the framing around arched shutters that are used to cover arched windows.

OBJECTS OF THE INVENTION

A primary object and feature of the present invention is to overcome the above-stated problems of the prior art.

It is a primary object and feature of the present invention to provide a system for reducing the light passing through gaps at the junction between the louvers and the frame of a shutter when the louvers are in the closed position.

Another object and feature of the present invention is to provide a system for reducing the light passing through the side of a shutter covering a French door window lite (i.e., pane of glass).

Yet another object and feature of the present invention is to provide a system for reducing the light passing through gaps at the framing of arched shutters.

A still further object and feature of this invention is to provide a novel and useful method of making shutters with such improved features.

It is a further object and feature of the present invention to provide such a system which is aesthetically pleasing, while minimizing light entry through the shutter.

A further primary object and feature of the present invention is to provide such a system which provides an improved system for maintaining the louvers in a user selected position.

A further primary object and feature of the present invention is to provide such a system which is efficient, inexpensive, and handy. Other objects and features of this invention will become apparent with reference to the following descriptions.

SUMMARY OF THE INVENTION

In accordance with a preferred embodiment hereof, this invention provides a shutter system for controlling entry of outside light into a building comprising: louver means for selectively regulating entry of the light into the building; wherein such louver means comprises a plurality of slats, each such slat comprising a pair of longitudinal edges, at least one slat end portion, each such slat end portion having a transverse edge; frame means for positionally supporting such louver means; wherein such frame means comprises at least one outside peripheral frame edge, at least one inside peripheral frame edge, a hollow middle area substantially equal in size to an area of light regulation by such slats of such louver means, a first face lying substantially in a first plane, and a second face opposing such first face and lying substantially in a second plane substantially parallel to such first plane; locating means for locating such louver means so that at least one such transverse edge is adjacent such at least one inside peripheral frame edge of such frame means, and no such longitudinal edges at such slat end portions extend beyond about such plane of such first face of such frame means; and blocking means for blocking substantially all the entry of the light adjacent at least one such slat end portion adjacent such at least one inside peripheral frame edge; wherein such first face of such frame means comprises such blocking means; and wherein such blocking means is located along such at least one inside peripheral frame edge; and wherein such blocking means extends inwardly from such at least one inside peripheral frame edge toward such hollow middle.

Additionally, it provides such a system further comprising: tilt rod means for operating such louver means; staple means for using staples to connect such tilt rod means to such louver means; wherein such staple means comprises at least one first staple penetrating at least one such slat of such louver means, and at least one second staple penetrating such tilt rod means, wherein penetration of such slat by such first staple is about one inch, and wherein penetration of such tilt rod means by such second staple is about one inch, wherein such first and second staples comprise a pivotable interlocking attachment between such first and second staples.

It also provides such a system wherein such frame means comprises an arch. And, it provides such a system wherein such blocking means comprises a rectangular-cross-section rod. Also, it provides such a system wherein such frame means comprises at least two stiles of approximately equal shape and at least two rails of approximately equal shape. Even further, it provides such a system wherein: such blocking means comprises a rectangular-cross-section rod; and such frame means comprises at least two stiles of approximately equal shape and at least two rails of approximately equal shape.

In accordance with another preferred embodiment hereof, this invention provides a shutter system for controlling entry of outside light into a building comprising: providing measurements of a rectangular area to be covered by a shutter; providing horizontal louvers of a selected standardized size; providing a pair of shutter side panels (stiles) of substantially equal size and permitting use of such louvers; providing a pair of shutter end panels (rails) of substantially equal size and having about the same width as such louvers; determine a number of louvers adequate to regulate light entry through a height approximately equal to the stile height less twice the rail height, assuming a desired minimum overlap between louvers; determine an actual louver vertical spacing, assuming equal overlaps between louvers; providing an appropriate number and spacing of louver pivot locations along an inside of each such stile; and assembling such shutter so as to provide a light blocker along an inside edge of each such stile structured and arranged to block entry of outside light between a louver end and an inside edge of a stile.

In accordance with yet another preferred embodiment hereof, this invention provides an arched shutter system comprising: assembling, from at least one piece of wood, a rough arch-shaped blank of desired size; removing excess wood material to provide a substantially continuous curved first arch-shaped piece having a desired first inner radius and a desired first outer radius; making an arch-shaped cut through such first arch-shaped piece in such manner as to provide a second arch-shaped piece and a third arch-shaped piece, wherein such second arch-shaped piece comprises such first outer radius and a second inner radius, such third arch-shaped piece comprises such first inner radius and a second outer radius, and such second inner radius is slightly more than such second outer radius; using such second arch-shaped piece in the manufacture of a surface mount arched shutter outer frame; and using such third arch-shaped piece in the manufacture of a surface mount arched shutter inner frame.

It also provides such a system further comprising providing a sill as a bottom chord of such arched shutter outer frame, whereby a viewer seeing a "matching" rectangular shutter mounted directly below such sill will be less able to distinguish small vertical misalignments.

In accordance with another preferred embodiment hereof, this invention provides an arched shutter system comprising: providing a second arch-shaped piece and a third arch-shaped piece, wherein such second arch-shaped piece comprises such first outer radius and a second inner radius, such third arch-shaped piece comprises such first inner radius and a second outer radius, and such second inner radius is slightly more than such second outer radius; using such second arch-shaped piece in the manufacture of an upper portion of a Z-mount arched shutter outer frame; using such third arch-shaped piece in the manufacture of a Z-mount arched shutter inner frame; assembling by attachment a three-part arched portion of such Z-mount arched shutter outer frame; wherein a first part comprises such second arch-shaped piece, a second part comprises a lower height (than such first part) arch-shaped spacer mounted to the rear of such first part, such second part having such second inner radius, a third part comprises an arch-shaped light blocking element mounted to the rear and below such second part, such assembled three-part arched portion comprises an approximate Z-shape; whereby the difficulties of cutting an approximate arched Z-shape from a single arched blank of wood are reduced.

In accordance with yet another preferred embodiment hereof, this invention provides a unitary outer frame for a shutter for an inside of a French door having a peripheral inside molding around an at least one glass pane comprising: frame means for positionally supporting a shutter; encasing means for encasing the molding in such manner as to permit the unitary outer frame to be adjacent the inside of the French door and adjacent such at least one glass pane; attachment means for attaching such unitary outer frame to such French door; wherein such encasing means and such frame means are opaque; whereby passage of light adjacent the molding is restricted. Moreover, it provides such a unitary outer frame further comprising: a shutter, having multiple slats, structured and arranged to block passage of light around at least one end of a such slat.

In accordance with another preferred embodiment hereof, this invention provides a shutter system for controlling entry of outside light into a building comprising: a shutter structured and arranged to regulate entry of the light into the building; wherein such shutter comprises a plurality of slats, each such slat comprising a pair of longitudinal edges, at least one slat end portion, each such slat end portion having a transverse edge; a shutter frame structured and arranged to positionally support such shutter; wherein such shutter frame comprises at least one outside peripheral frame edge, at least one inside peripheral frame edge, a hollow middle area substantially equal in size to an area of light regulation by such slats of such shutter, a first face lying substantially in a first plane, and a second face opposing such first face and lying substantially in a second plane substantially parallel to such first plane; such shutter and shutter frame being structured and arranged to provide that at least one such transverse edge is adjacent such at least one inside peripheral frame edge of such shutter frame, and no such longitudinal edges at such slat end portions extend beyond about such plane of such first face of such shutter frame; and a light blocker structured and arranged to block substantially all the entry of the light adjacent at least one such slat end portion adjacent such at least one inside peripheral frame edge; wherein such first face of such shutter frame comprises such blocker; and wherein such blocker is located along such at least one inside peripheral frame edge; and wherein such blocker extends inwardly from such at least one inside peripheral frame edge toward such hollow middle.

It also provides such a system further comprising: a tilt rod structured and arranged to operate such shutter; staples structured and arranged to connect such tilt rod to such shutter, at least one first staple penetrating at least one such slat of such shutter, and at least one second staple penetrating such tilt rod, wherein penetration of such slat by such first staple is about one inch, and wherein penetration of such tilt rod by such second staple is about one inch wherein such first and second staples comprise a pivotable interlocking attachment between such first and second staples.

Further, it provides such a system wherein such shutter frame comprises an arch. And, it provides such a system wherein such blocker comprises a rectangular-cross-section rod. Also, it provides such a system wherein such shutter frame comprises at least two stiles of approximately equal shape and at least two rails of approximately equal shape. It also provides such a system wherein: such blocker comprises a rectangular-cross-section rod; and such shutter frame comprises at least two stiles of approximately equal shape and at least two rails of approximately equal shape.

DETAILED DESCRIPTION OF A PREFERRED EMBODIMENT OF THE INVENTION

Figure 1:
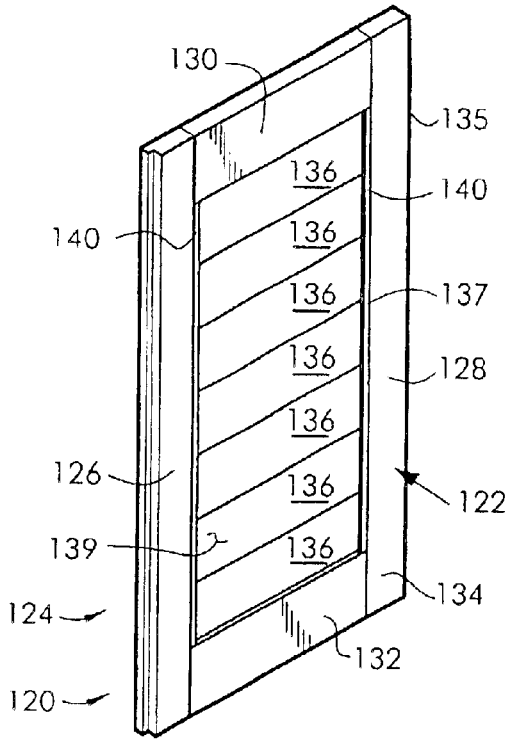
FIG. 1 is a perspective view of the rear face of the shutter system according to a preferred embodiment of the present invention.
Figure 3:
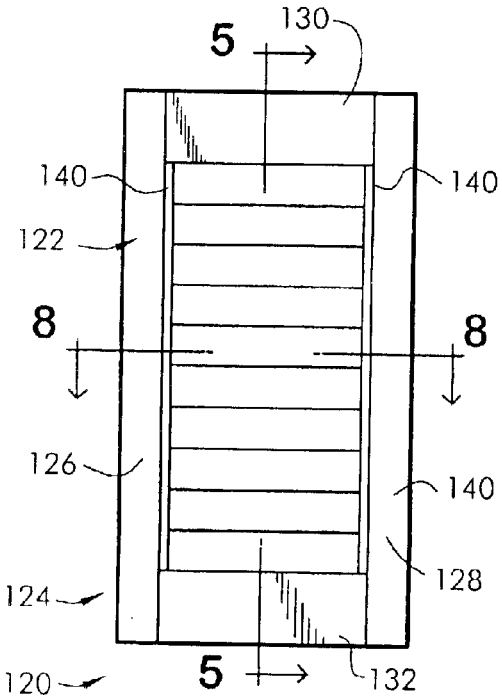
FIG. 3 is a front view of the rear face of the shutter of FIG. 1 according to a preferred embodiment of the present invention.

Referring now to the drawings, FIG. 1 is a perspective view of the rear face 122 (embodying herein a first face lying substantially in a first plane) of the shutter system 120 according to a preferred embodiment of the present invention. FIG. 3 is a front view of the rear face 122 of the shutter 124 of FIG. 1 according to a preferred embodiment of the present invention. Preferably, shutter 124 (embodying herein a shutter structured and arranged to regulate entry of the light into the building) comprises two vertical members or stiles 126 and 128, two horizontal members or rails, a top rail 130 and a bottom rail 132. Preferably, the stiles 126 and 128 and rails 130 and 132 are joined together (e.g. by stapling, nailing, gluing and/or use of a joiner tool) to form a rectangular frame 134 (embodying herein a shutter frame structured and arranged to positionally support such shutter; and, frame means for positionally supporting such louver means) having an outside peripheral frame edge 135 and an inside peripheral frame edge 137, having a hollow middle portion 139 (best viewed in FIG. 6)(embodying herein wherein such shutter frame comprises at least one outside peripheral frame edge, at least one inside peripheral frame edge, a hollow middle area substantially equal in size to an area of light regulation by such slats of such shutter). Under appropriate circumstances, other arrangements may suffice. For example, under appropriate circumstances, the shutter may be square, triangular, or another custom-shape.

Preferably, the shutter 124 also comprises several louvers 136 (embodying herein louver means for selectively regulating entry of the light into the building) which are preferably housed within the hollow middle portion 139 (referring to the space within the rectangular frame 134 when no louvers 136 are present) of the rectangular frame 134 (the above arrangement embodies herein a hollow middle area substantially equal in size to an area of light regulation by such slats of such louver means; and also embodies herein a hollow middle area substantially equal in size to an area of light regulation by such slats of such shutter). Preferably, louvers 136 are slats having a pair of longitudinal edges 151 and two ends 153, each having a transverse edge pivotally attached to the stiles 126 and 128 (embodying herein wherein such louver means comprises a plurality of slats, each such slat comprising a pair of longitudinal edges, at least one slat end portion, each such slat end portion having a transverse edge). Preferably, the louvers 136 are arranged such that each transverse edge is adjacent the inside peripheral edge 137 (embodying herein such shutter and shutter frame being structured and arranged to provide that at least one such transverse edge is adjacent such at least one inside peripheral frame edge of such shutter frame).

Preferably, the shutter system 120 uniquely adds the use of a light-blocking element 140 (embodying herein blocking means and a blocker) attached to each stile 126 and 128, as shown. Preferably, the light-blocking element 140 is a rectangular cross-section-rod, as shown (embodying herein wherein such blocking means comprises a rectangular-cross-section rod). In most shutters, closing the shutter 124 or moving the louvers 136 to a position in which they overlap each other, significantly reduces the light passing through the shutter 124. The light-blocking element 140 further assists the light-blocking process of the shutter 124 by blocking light passing through the junction 138 between the louvers 136 and the frame 134 (viewed best in FIG. 8) (this arrangement embodies herein a light blocker structured and arranged to block substantially all the entry of the light adjacent at least one such slat end portion adjacent such at least one inside peripheral frame edge; and, embodies herein blocking means for blocking substantially all the entry of the light adjacent at least one such slat end portion adjacent such at least one inside peripheral frame edge). Such a light-blocking element 140 only works in conjunction with a shutter 124 in which the louvers 136 are arranged such that the louvers 136 never (in any louver position) extend beyond the plane of the rear face 122 of the frame 134 (embodying herein locating means for locating such louver means so that at least one such transverse edge is adjacent such at least one inside peripheral frame edge of such frame means, and no such longitudinal edges at such slat end portions extend beyond about such plane of such first face of such frame means; and embodying herein such shutter and shutter frame being structured and arranged to provide that at least one such transverse edge is adjacent such at least one inside peripheral frame edge of such shutter frame, and no such longitudinal edges at such slat end portions extend beyond about such plane of such first face of such shutter frame). Use of a center pivoting louver, (for example, as described in U.S. Pat. No. 5,020,276) would not function with such a light blocking element 140 as the louvers 136 would collide with the light blocking element 140.

Figure 2:
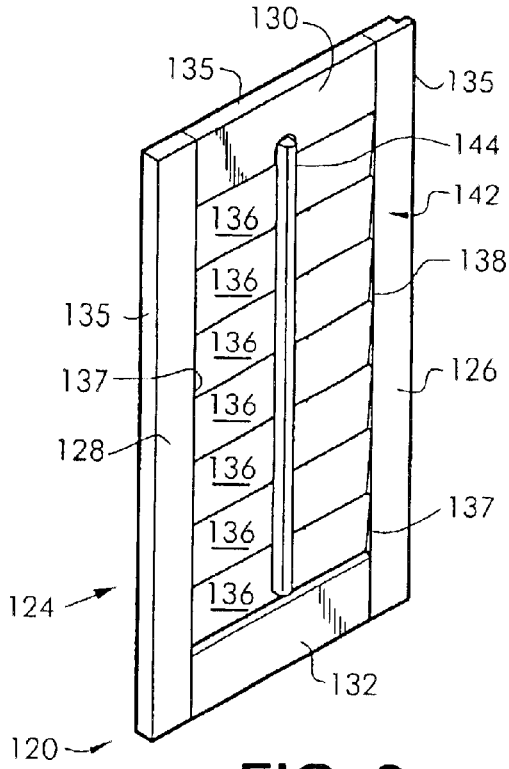
FIG. 2 is a perspective view of the front face of the shutter system according to a preferred embodiment of the present invention.
Figure 4:
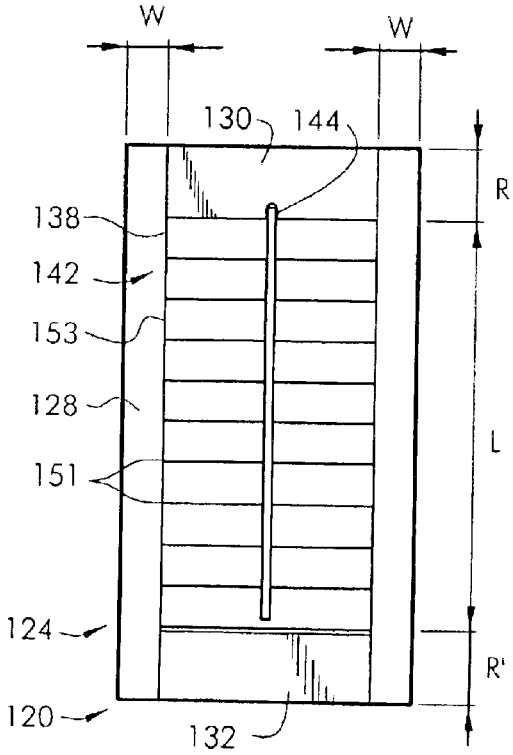
FIG. 4 is a front view of the front face of the shutter of FIG. 2 according to a preferred embodiment of the present invention.

FIG. 2 is a perspective view of the front face 142 (embodying herein a second face opposing such first face and lying substantially in a second plane substantially parallel to such first plane) of the shutter system 120 according to a preferred embodiment of the present invention. FIG. 4 is a front view of the front face 142 of the shutter 124 of FIG. 2 according to a preferred embodiment of the present invention.

Figure 5:
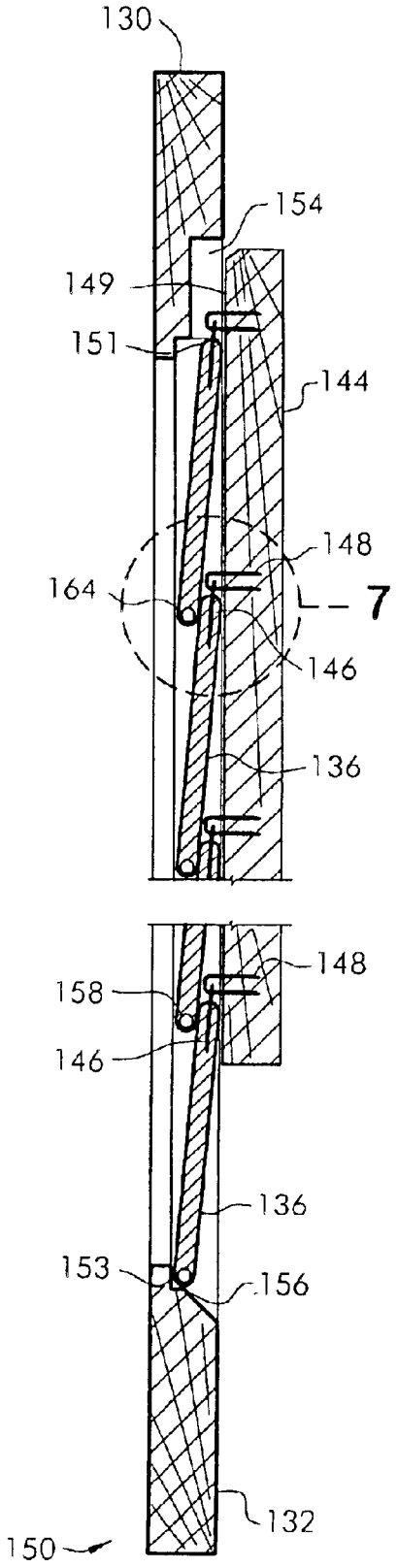
FIG. 5 is a sectional view, partially in section, through section 5—5 of FIG. 3, illustrating the shutter louvers in a closed position.
Figure 6:
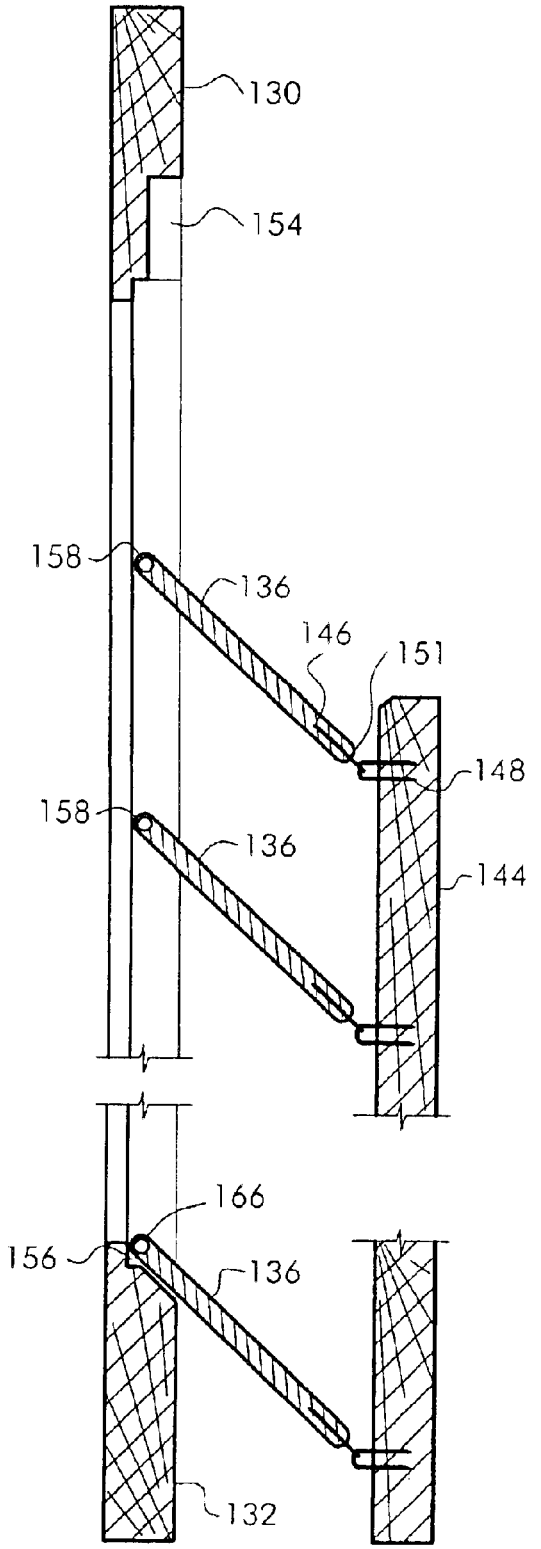
FIG. 6 is a sectional view, partially in section, similar to FIG. 5 but illustrating the louvers in an open position.
Figure 7:
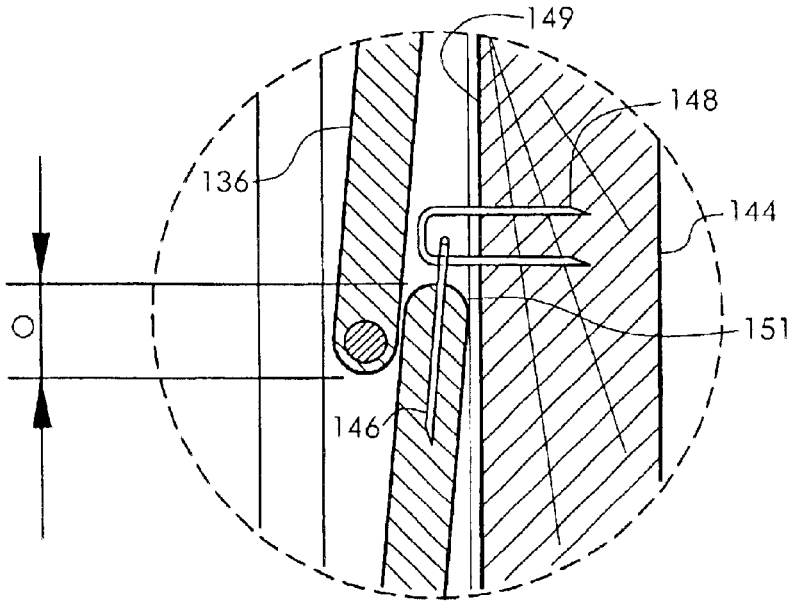
FIG. 7 is an expanded view of Area 7 of FIG. 5.

FIG. 5 is a sectional view 150, partially in section, through section 5—5 of FIG. 3, illustrating the louvers 136 in a closed position. FIG. 6 is a sectional view 152, partially in section, similar to FIG. 5 but illustrating the louvers 136 in an open position. FIG. 7 is a sectional view, partially in section, of Area 7 of FIG. 5 illustrating the connection between tilt rod 144 and louver 136.

More detailed reference is now made to the above-described Figures. Preferably, the louvers 136 are connected together by a tilt rod 144 (embodying herein a tilt rod structured and arranged to operate such shutter; and, tilt rod means for operating such louver means) such that the louvers 136 may be moved in unison. The tilt rod 144 is preferably a U-shaped wooden rod. Preferably, the tilt rod 144 is connected to each of the louvers 136 utilizing a first staple 146 in the louver 136 and a second staple 148 on the tilt rod 144 (embodying herein staple means for using staples to connect such tilt rod means to such louver means, wherein such staple means comprises at least one first staple penetrating at least one such slat of such louver means, and at least one second staple penetrating such tilt rod means; and, staples structured and arranged to connect such tilt rod to such shutter, at least one first staple penetrating at least one such slat of such shutter, and at least one second staple penetrating such tilt rod). Preferably, the staples 148 are inserted into the flat portion 149 of the tilt rod 144, staples 148 being preferably coupled to staples 146 inserted into one longitudinal edge 151 of a longitudinal side of the louver 136 forming a pivotal interlocking attachment (embodying herein wherein such first and second staples comprise a pivotable interlocking attachment between such first and second staples). Preferably, the tilt rod 144 is positioned on the front face 142 of the shutter. Typically, in the prior art, a one-half inch staple penetration is utilized. However, in the present preferred shutter system 120, the louver 136 and tilt rod 144 preferably will accept up to about one-inch long staple penetration. Under appropriate circumstances, other size staples may suffice, however, the preferred one-inch staple is durable and provides a firm connection which is not easily removed.

Preferably, both the first staple 146 and the second staple 148 penetrate their respective louver 136 and tilt rod 144 about one inch (this arrangement embodies herein wherein penetration of such slat by such first staple is about one inch, and wherein penetration of such tilt rod means by such second staple is about one inch). The additional penetration of the staples 146 and 148 reduces instability common in prior art tilt-rod-to-louver connections that occurs over an extended period of use. Specifically preferred herein is to use a tilt rod about ⅛" deeper than typical and use one-inch long staples in the tilt rod, providing a penetration of the staple of about ⅞"; and to use also a crown staple for the louver, the staple being sized at 1⅜' long, providing a penetration of about 1¼" (this making up for the thinness of the louver and better resisting breakage). Also, it is noted that, for best results, the spacing of the staples along the tilt rod should follow the same formula as the pivot hole spacing herein described.

Preferably, shutter system 120 utilizes a louver 136 that is pivoted such that no part of the louver 136 passes the plane of the rear face 122 of the shutter 124 as shown in FIG. 6. This is preferred as the light blocking element 140 is preferably attached to the stiles 126 and 128 such that the light blocking element 140 is flush with the plane of the rear face 122 of the shutter 124. Under appropriate circumstances, positions of the light-blocking element 140 other than flush with the plane of the rear face 122 may suffice, however, they are not preferred.

Preferably, in order to prevent light from passing through the shutter at the intersection of the louvers 136 and the top rail 130, as well as the louvers 136 and the bottom rail 132, when in the closed position 150, a portion of the top rail 130 and the bottom rail 132 is removed. This type of removed area is commonly called a "rabbit" relief in the woodworking art but will be referred to herein as a recess 154 for the top rail 130 and recess 156 for the bottom rail 132 (best illustrated in FIG. 5 and FIG. 6). The wood remaining after these recesses are routed out act as bottom and top light blocking elements. Preferably, the louvers 136 rest within the recess 154 and 156 when in the closed position 150. Preferably, the vertical height of the recesses 154 and 156 is about one-half inch. Preferably, the use of the recesses 154 and 156 in combination with the light blocking element 140 provides for a much improved shutter system 120 and reduction of light passing through the shutter 124 when in the closed position 150.

Figure 8:
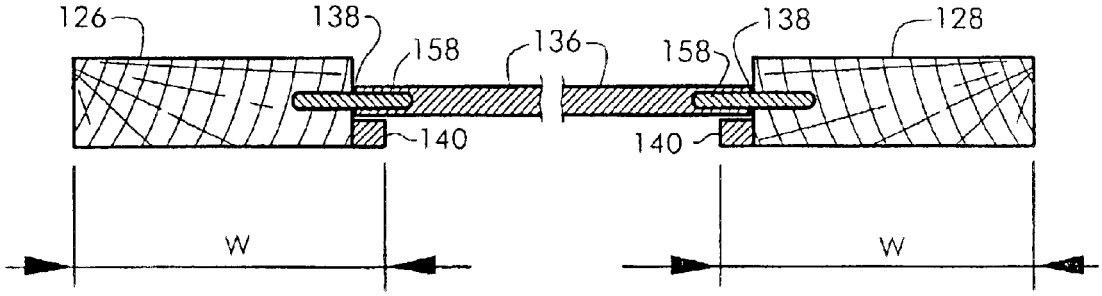
FIG. 8 is a sectional view through section 8—8 of FIG. 3.
Figure 11:
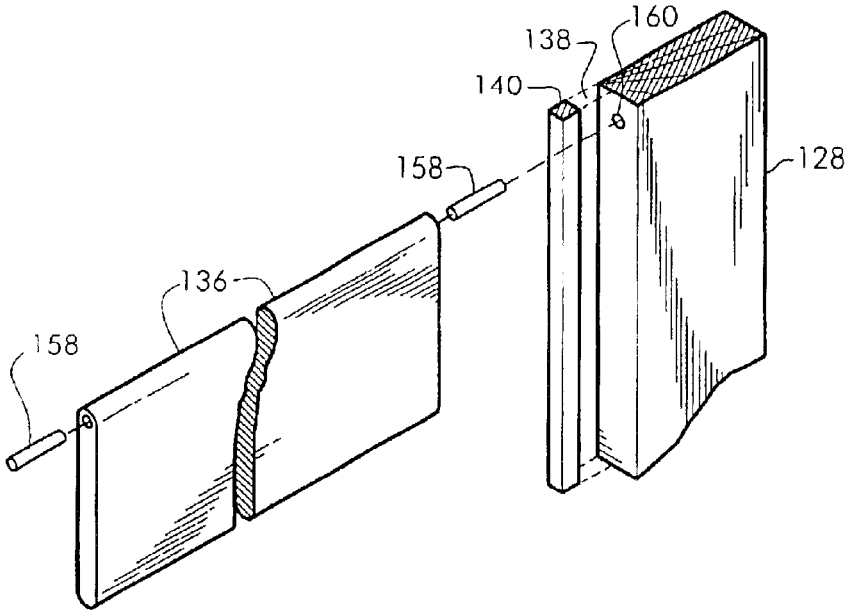
FIG. 11 is an exploded perspective view, partially in section, illustrating a louver, light stop and louver attachment.

FIG. 8 is a sectional view through section 8—8 of FIG. 3; and FIG. 11 is a perspective view, partially in section, illustrating an exploded view of a louver 136, light stop 140, louver attachment pin 158 and stiles 126 and 128. Illustrated in section in FIG. 8 and in perspective in FIG. 11 is the preferred arrangement of the louver 136, light stop 140 and louver attachment pin 158 to the stiles 126 and 128. Preferably, stiles 126 and 128 are equal in width as indicated by Dimension W and Dimension W', where Dimension W is equal to Dimension W' (embodying herein such shutter frame comprises at least two stiles of approximately equal shape). Louvers 136 are attached pivotally to the stiles 126 and 128 by use of pins 158 which are preferably inserted into both the louver 136 and the respective stiles 126 and 128, as shown. Preferably, the shutter system 120 also comprises at least one set of center-mounted resistors, preferably friction pins, which assist in maintaining an angular position of the louvers. Alternate embodiments of such center-mounted resistors are described in reference to FIG. 31 through FIG. 35 below.

Preferably, light blocking element 140 is attached, as shown, to each respective stile 126 and 128 such that light blocking element 140 is flush with the rear face and will block any light passing through junction 138 (this arrangement embododies herein a light blocker structured and arranged to block substantially all the entry of the light adjacent at least one such slat end portion adjacent such at least one inside peripheral frame edge; wherein such first face of such shutter frame comprises such blocker; and wherein such blocker is located along such at least one inside peripheral frame edge; and wherein such blocker extends inwardly from such at least one inside peripheral frame edge toward such hollow middle; and, also embodies herein blocking means for blocking substantially all the entry of the light adjacent at least one such slat end portion adjacent such at least one inside peripheral frame edge; wherein such first face of such frame means comprises such blocking means; and wherein such blocking means is located along such at least one inside peripheral frame edge; and wherein such blocking means extends inwardly from such at least one inside peripheral frame edge toward such hollow middle). Preferably, the above attachment of light blocking element 140 to each respective stile 126 and 128 is made by using glue and wood staples. Under appropriate circumstances, other methods of attachment may suffice.

Another feature of the shutter system 120 is that the top rail 130 and the bottom rail 132 are preferably made in equal dimensions (height and width). FIG. 4 illustrates the preferred Height R and Height R', where Height R is equal to Height R' (this arrangement embodies herein at least two rails of approximately equal shape). In order to make the shutter 124 with equal height top rail 130 and bottom rail 132, it is necessary to arrange the louvers 136 in a custom manner with a custom-dimensioned (for each measured job) Overlap O (shown in FIG. 7). Typically, prior art louvers are pre-assembled in the stiles 126 and 128 in set lengths, and arranged depending on the louver height in increments that are equal in Overlap O. For example, a three and one-half inch wide louver (front to rear dimension) would typically have about a one-half inch Overlap O. The spacing for the holes 160 (shown only in FIG. 11) in which the pin 158 is placed in the stiles 126 and 128 would preferably be three inches in the above example (three and one-half inches less a one-half inch overlap). Preferably, determining the number of louvers needed to cover the distance between the top and bottom rails, Distance L, is determined by a simple formula as follows: The Distance L between the top and bottom rails divided by the Louver width less one-half inch (the preferred overlap) which equals the No. of louvers.

For example, if the distance L (FIG. 4) is 30" and the louver 136 width is 3½", then 30" divided by (3.5" minus 0.5") equals 10. Therefore, in this example, there are ten 3.5" louvers 136 necessary to cover the space between the top rail 130 and the bottom rail 132 (Distance L) with a one-half inch overlap. Typically, when producing a shutter 124 for a building opening such as a window, the shutter 124 dimensions are determined and the shutter 124 is made by determining how many louvers 136 are needed and what size the top rail 130 and the bottom rail 132 will be to accommodate the use of the pre-assembled louvers 136/stiles 126 and 128 sub-assembly. Typically, the pre-assembled louvers 136/stiles 126 and 128 sub-assembly are attached to the bottom rail 132 and then cut-off at the top and the top rail 130 is attached. Unless by accident, the top rail 130 and the bottom rail 132 are not equal in their dimension. The present invention provides manufacturing the top rail 30 and the bottom rail 132 such that they are always equal in dimension.

In a preferred embodiment of a method of manufacturing the shutter 124 of the present invention, the window distance from top to bottom of the opening is measured (embodying herein providing measurements of a rectangular area to be covered by a shutter). Preferably, a top rail 130 and bottom rail 132 are provided along with selection of the louver 136 size and a pair of stiles 172 and 174 are selected (the above arrangement embodies herein providing horizontal louvers of a selected standardized size; providing a pair of shutter side panels (stiles) of substantially equal size and permitting use of such louvers; providing a pair of shutter end panels (rails) of substantially equal size and having about the same width as such louvers). Preferably, the top rail 130 and the bottom rail 132 dimension is subtracted (as they are equal in dimension). Then the distance L (FIG. 4) is determined and the number of louvers 136 is figured utilizing the above-described formula (embodying herein determine a number of louvers adequate to regulate light entry through a height approximately equal to the stile height less twice the rail height, assuming a desired minimum overlap between louvers). Preferably, if the number of louvers 136 is not exact the number is rounded down or up to the nearest whole number. The remaining louvers 136 are then spaced equally between the top rail 130 and the bottom rail 132 in a custom installation unlike the prior art installation method. The holes 160 are custom drilled into the stiles 126 and 128 (this arrangement embodies herein determine an actual louver vertical spacing, assuming equal overlaps between louvers; providing an appropriate number and spacing of louver pivot locations along an inside of each such stile). In order to determine the starting position of the top louver and the bottom louver pin 158 holes, a simple scribe tool 162 is used. Such a scribe tool 162 is illustrated in FIG. 9 and FIG. 10.

Figure 9:
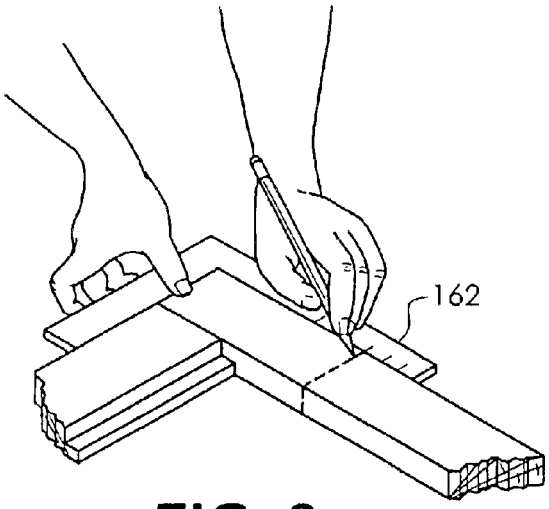
FIG. 9 is a perspective view, partially in section, illustrating a method of measuring the top louver placement in the shutter frame according to a preferred embodiment of the present invention.
Figure 10:
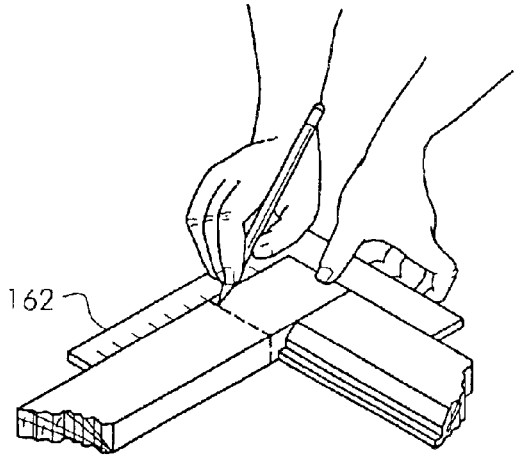
FIG. 10 is a perspective view, partially in section, illustrating a method of measuring the bottom louver placement in the shutter frame according to a preferred embodiment of the present invention.

FIG. 9 is a perspective view, partially in section, illustrating a method of measuring the top louver placement in the shutter frame according to a preferred embodiment of the present invention. FIG. 10 is a perspective view, partially in section, illustrating a method of measuring the bottom louver placement in the shutter frame according to a preferred embodiment of the present invention. Preferably, the scribe tool 162 is used to assist in the placement of the first louver pin hole 164 (see FIG. 5) placed below the top rail 130 of the shutter 124 and the final bottom louver pin hole 166 (see FIG. 6) placed above the bottom rail 132 of the shutter 124. Preferably, the louver pinhole 164 allows for the top louver to tightly fit into recess 154 when in the closed position 150. Preferably, the placement of the louver pinhole 164 is calculated as: the height of the top rail, plus one-sixteenth inches, plus the width of the louver, minus one-half the thickness of the louver.

Preferably, louver pinhole 166 allows for the bottom louver to tightly fit into recess 156 when in the closed position 150. Preferably, the placement of the louver pinhole 166 is calculated as: the height of the bottom rail, plus one-sixteenth inches, plus one-half the thickness of the louver. Preferably, the remaining louvers 136 are then equally spaced apart. Preferably, the spacing is such that the louvers 136 have an overlap which is more or less within about one-eighth of an inch of the desired one-half inch. In the above example of ten louvers there would be eight remaining middle louvers 136 allowing for an adjustment of at least an inch (⅛-inch times 8 louvers equal one inch) of space (to make up the difference between an extra louver 136 or one less louver 136 in the rounding process described above). Under appropriate circumstances, other arrangements may suffice. Preferably, light blocking element 140 is attached, as shown, lastly, to each respective stile 126 and 128 such that light blocking element 140 is flush with the rear face and will block the light between the louver end 153 and the inside peripheral edge 137 (embodying herein assembling such shutter so as to provide a light blocker along an inside edge of each such stile structured and arranged to block entry of outside light between a louver end and an inside edge of a stile).

Figure 12:
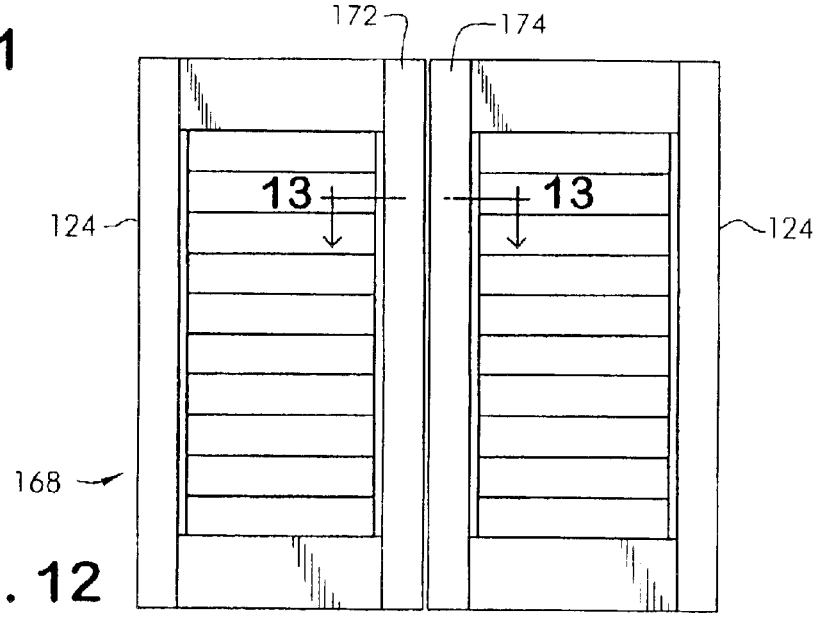
FIG. 12 is a plan view of a rear of a dual shutter according to a preferred embodiment of the present invention.
Figure 13:
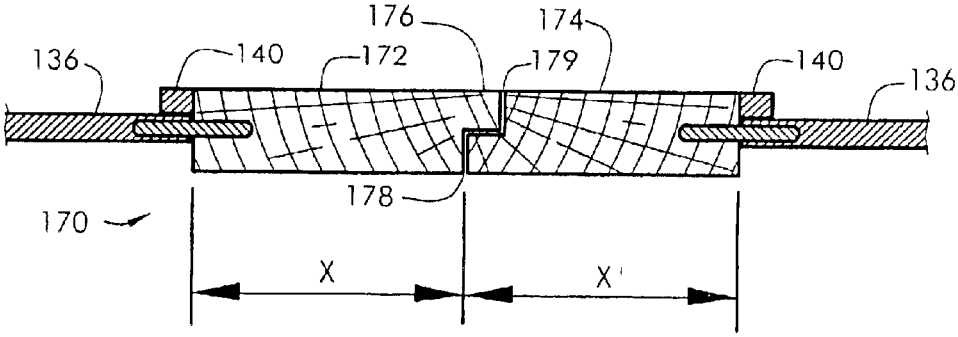
FIG. 13 is a sectional view through section 13—13 of FIG. 12.

Reference is now made to FIG. 12 and FIG. 13. FIG. 12 is a front view of a dual shutter 168 according to a preferred embodiment of the present invention. FIG. 13 is a sectional view through section 13—13 of FIG. 12. Typically, shutters 124 are limited in width; and in building openings that are greater than about 24 inches; it is preferable to utilize a multiple shutter arrangement such as the dual shutter 168 shown in FIG. 12. When such a shutter 168 is used, it is preferably comprised of two or more smaller width shutters 24. The present invention provides that the front face 170 of the stiles 172 and 174 is such that both the stiles 172 and 174 appear to be about equal in width X and X'. This "equalness" is accomplished by simply elongating one of the stile ends 176 about one-quarter of an inch such that the stile 172 is slightly longer and will overlap the other stile 176, as shown (FIG. 13). Under appropriate circumstances, other overlap arrangements may suffice. Preferably, stile 172 and stile 174 each have a respective recess (rabbit cut) 178 and 179 into which the opposite stile will fit flush, as shown. This an improvement over the prior art method of making both stiles identical and using perhaps a "bead" on the edge of the larger front stile face adjacent to the smaller style to hide the otherwise apparent lack of "equalness".

Figure 14:
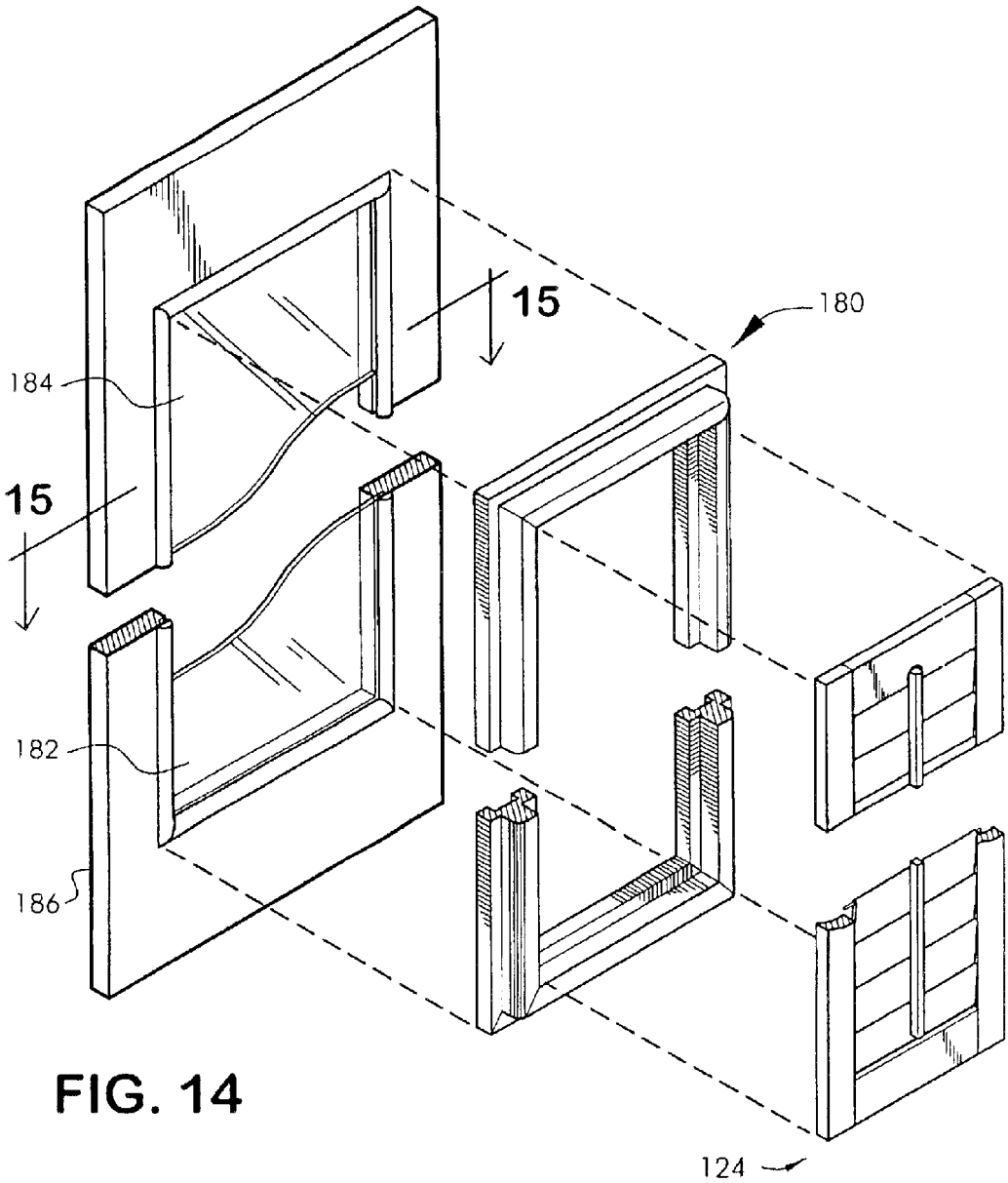
FIG. 14 is an exploded perspective view, partially in section, illustrating a door pane shutter and frame according to a preferred embodiment of the present invention.
Figure 15:
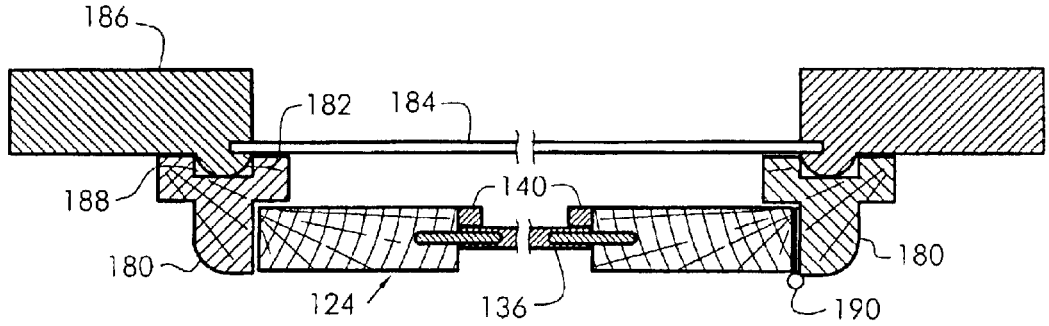
FIG. 15 is a sectional view through section 15—15 of FIG. 14.

Reference is now made to FIG. 14 and FIG. 15. FIG. 14 is an exploded perspective view, partially in section, illustrating a door lite (pane) shutter 124 and light blocking frame 180 according to a preferred embodiment of the present invention.

FIG. 15 is a sectional view through section 15—15 of FIG. 14. This embodiment allows for a further light blocking feature of the present invention, that being a light blocking frame 180 as illustrated in FIG. 14 and FIG. 15. Preferably, light blocking frame 180 is utilized on doors 186 which have an exterior molding 182 surrounding the light opening 184, such as French doors. Preferably, frame 180 is a solid unitary frame 180, molded of wood and formed, as shown, such that the frame 180 comprises a recess 188 which effectively encompasses the molding 182, thus blocking light from passing around the frame 180. Under appropriate circumstances, other arrangements may suffice. For example, the frame may not be unitary. Preferably, frame 180 also is structured and arranged, as shown, such that shutter 124 is attached to the frame 180 and the frame is attached to the door 186 (the above arrangement embodies herein frame means for positionally supporting a shutter; encasing means for encasing the molding in such manner as to permit the unitary outer frame to be adjacent the inside of the French door and adjacent such at least one glass pane; attachment means for attaching such unitary outer frame to such French door; wherein such encasing means and such frame means are opaque; whereby passage of light adjacent the molding is restricted). Preferably, shutter 124 is hingedly attached to the frame 180 as illustrated by hinge 190. The hinge 190 is preferred to provide access to the door light opening 184 for cleaning and also for shutter 124 maintenance.

Figure 16:
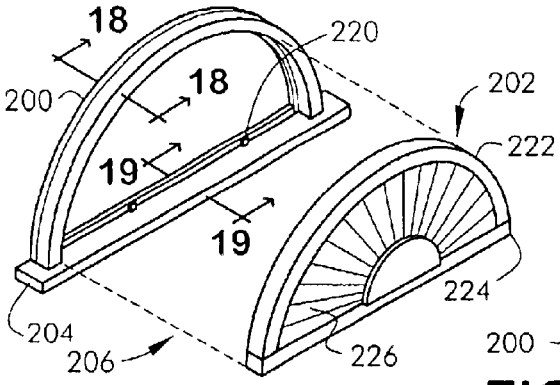
FIG. 16 is an exploded perspective view of an arched frame, shutter and sill of a wall surface mounted shutter system of an arched shutter according to another preferred embodiment of the present invention.
Figure 17:
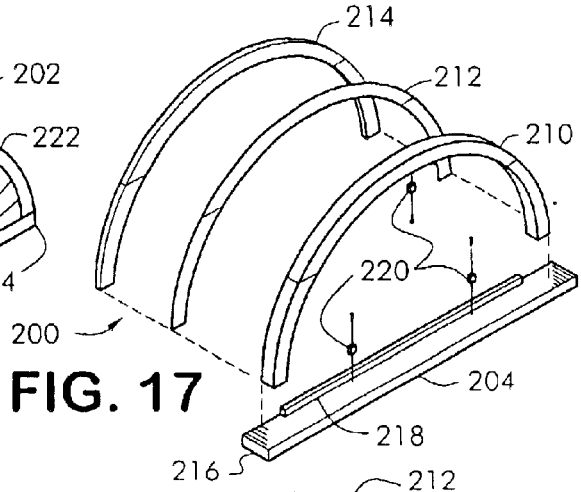
FIG. 17 is an exploded perspective view, illustrating the multiple parts of an arched frame and sill of the wall surface mounted shutter system of FIG. 16.

Reference is now made to FIG. 16. FIG. 16 is an exploded perspective view of an arched frame 200, arched shutter 202 and sill 204 of a wall-surface-mounted shutter system 206 of an arched shutter 202 according to another preferred embodiment of the present invention. FIG. 17 is an exploded perspective view illustrating the multiple parts of an arched frame 200 and sill 204 of the arched wall-surface-mounted shutter system of FIG. 16.

Figure 19:
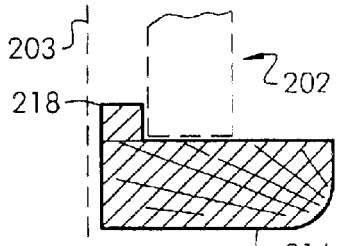
FIG. 19 is a sectional view through section 19—19 of FIG. 16.

Preferably, the arched wall-surface-mounted shutter system 206 comprises an arched shutter 202, an arched frame 200, and a sill 204. Preferably, the arched frame 200 comprises a facing arch 210, a spacer 212 and a light stop 214. As illustrated in FIG. 19, the sill 204 preferably comprises a substantially horizontal bar member 216 and a light stop 218. Preferably, sill 204 is a unique feature in the shutter art and is used in this embodiment of the present invention to create a visual break (so that any slight differences in the "matching" geometry above and below the sill is less noticeable to the human eye) between the arched wall surface mounted shutter system 206 and the shutter system 120 which is typically installed in the normal rectangular portion of a window (this arrangement embodying herein providing a sill as a bottom chord of such arched shutter outer frame, whereby a viewer seeing a "matching" rectangular shutter mounted directly below such sill will be less able to distinguish small vertical misalignments).

Preferably, the arched frame 200 is attached to the sill 204 as shown. Preferably, arched shutter 202 removably attaches within the arched frame 200. Preferably, the arched shutter 202 removably attaches within the arched frame 200 utilizing attaching hardware 220, which preferably comprises a button catch or a magnetic latch. Preferably, the arched shutter 202 comprises an arch portion 222, a bottom portion 224 and a louver portion 226. Preferably, the arched wall-surface-mounted shutter system 206 mounts such that the arched shutter 202 and the arched frame 200 are flush against the wall 203 framing the window opening (not shown).

Figure 20:
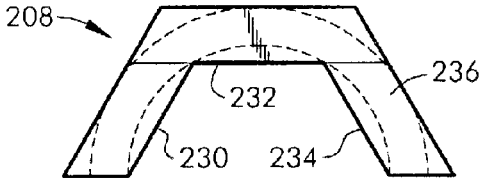
FIG. 20 is a front view illustrating steps in a method of making the facing arch of the arched frame and the arch portion for the arched shutter of FIG. 16 according to a preferred embodiment of the present invention.
Figure 21:
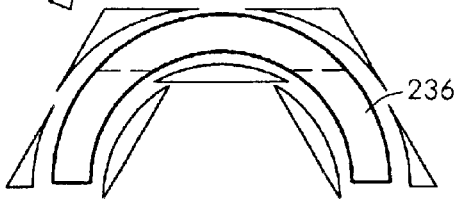
FIG. 21 is a front view illustrating further steps in a method of making the facing arch of the arched frame and the arch portion for the arched shutter of FIG. 16.
Figure 22:
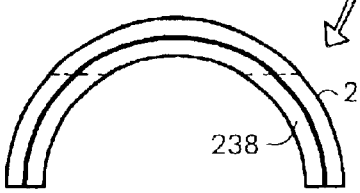
FIG. 22 is a front view illustrating yet further steps in a method of making the facing arch of the arched frame and the arch portion for the arched shutter of FIG. 16.

In a preferred embodiment of the present invention, this invention provides a method for producing an arched frame 200 and an arched shutter 202 portion from a singular pattern 208, such as that illustrated in FIGS. 20–22. In the prior art, the arched frame 200 and the arch portion 222 are made as separate pieces. The improvement, in combination with the shutter system 120 of the present invention, provides the facing arch 210 of the arched frame 200 and the arch portion 222 are made from a singular pattern 208, as shown. FIG. 20 is a front view illustrating a manufacturing step(s) in a method of making the facing arch 210 of the arched frame 200 and the arch portion 222 for the arched shutter 202 of FIG. 16 according to a preferred embodiment of the present invention. Preferably, a pattern 208 is created utilizing the actual interior window dimensions desired for placing the arched wall surface mounted shutter system 206 in a position to cover the window (building light opening).

Preferably, three portions 230, 232 and 234 are combined in a pattern 208, as shown, such that an arch 236 may be cut from the pattern 208 (embodying herein assembling, from at least one piece of wood, a rough arch-shaped blank of desired size). Preferably, the pattern 208 and arch 236 are made of wood and the portions 230, 232 and 234 are combined using glue and joining biscuits. Such combining of wood is well known by those skilled in the art. Under appropriate circumstances other materials and methods may suffice.

It is noted that the pivot locations for the arch louvers, similarly as for the non-arched, must be located so that the arch louvers do not break the plane of the shutter face, permitting the instant light blocking.

FIG. 21 is a front view illustrating another step(s) in a method of making the facing arch 210 of the arched frame 200 and the arch portion 222 for the arched shutter 202 of FIG. 16. FIG. 21 illustrates the cutting out of the arch 236 (embodying herein removing excess wood material to provide a substantially continuous curved first arch-shaped piece having a desired first inner radius and a desired first outer radius). FIG. 22 is a front view illustrating yet another step(s) in a method of making the facing arch 210 of the arched frame 200 and the arch portion 222 for the arched shutter 202 of FIG. 16. FIG. 22 illustrates the preferred and unique method of cutting two arches 238 and 240 from a single arch 236 (embodying herein making an arch-shaped cut through such first arch-shaped piece in such manner as to provide a second arch-shaped piece and a third arch-shaped piece, wherein such second arch-shaped piece comprises such first outer radius and a second inner radius, such third arch-shaped piece comprises such first inner radius and a second outer radius, and such second inner radius is slightly more than such second outer radius). This improvement permits arched shutters of this type wherein the grains of the arches 238 and 240 are matched, a very useful end not accomplished by the prior art method of making these arches out of separate pieces of wood (embodying herein whereby such second and third arch-shaped pieces, being adjacently located when such inner and outer frames are assembled, will be closely matched in dimension and grain). Preferably arch 238 becomes arch portion 222 for the arched shutter 202 (embodying herein using such third arch-shaped piece in the manufacture of a surface mount arched shutter inner frame). Preferably, arch 240 becomes facing arch 210 for the arched frame 200 (embodying herein using such second arch-shaped piece in the manufacture of a surface mount arched shutter outer frame).

Figure 18:
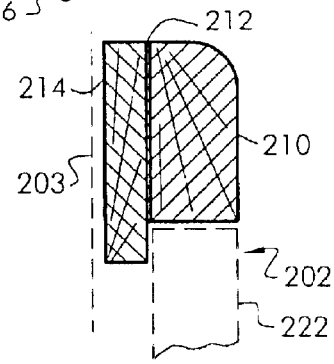
FIG. 18 is a sectional view through section 18—18 of FIG. 16.
Figure 23:
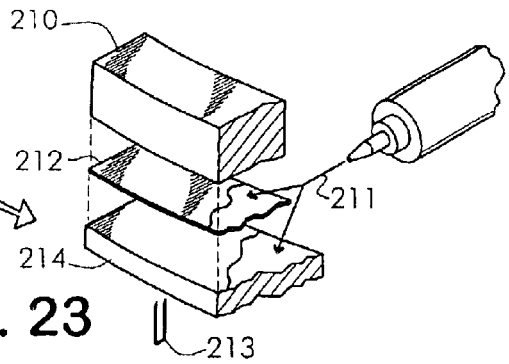
FIG. 23 is a perspective view illustrating still further steps in a method of making the facing arch of the arched frame for the arched shutter of FIG. 16.

The next step in the method of making the arched wall-surface-mounted shutter system 206 is to increase the thickness of the facing arch 210 by preferably attaching a spacer 212 and a light stop 214 to the facing arch 210, preferably by gluing 211 and staples 213, as illustrated by FIG. 23 (also seen in perspective in FIG. 17 and in section by FIG. 18). Preferably spacer 212 is an about-one-sixteenth-inch-thick spacer, just enough to provide a distance for the use of the attaching hardware 220 which preferably has matching male-female parts which attaches the arched shutter 202 within the arched frame 200. The light stop 214 prevents light from passing around the arch portion 222 of the arched shutter 202. Preferably, the combined facing arch 210, spacer 212 and light stop 214 comprise the arched frame 200.

The next step in the method of making the arched wall-surface-mounted shutter system 206 is to attach the arched frame 200 to the sill 204 and preferably attach the female portion of the attaching hardware 220, as shown. Further, the arch portion 222 is attached to the bottom portion 224 and shutter portion 226 to comprise the arched shutter 202. Preferably, the arched shutter 202 is then connected to the arched frame 200 and sill 204 completing the arched wall-surface-mounted shutter system 206. Under appropriate circumstances, those knowledgeable in the art may add additional painting, molding details, or other aesthetic features without detracting from the functionality of the present invention.

Figure 26:
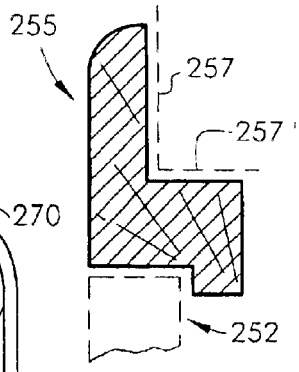
FIG. 26 is a sectional view through section 26—26 of FIG. 24 and FIG. 25.
Figure 27:
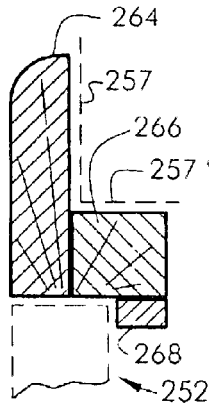
FIG. 27 is a sectional view through section 27—27 of FIG. 24.

Reference is now made to FIG. 24 through FIG. 30. In another preferred embodiment of the present invention, this invention provides a method for producing an arched portion 256 comprising arched face frame portion 264, frame portion 266 and light stop 268. The improvement, in combination with the shutter system 120, provides a method for making the arched portion 256 from three separate pieces as illustrated in FIG. 27.

Figure 24:
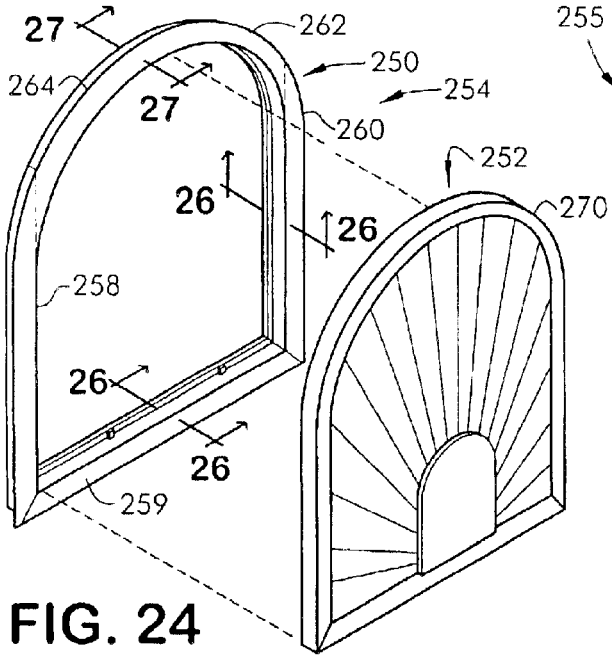
FIG. 24 is an exploded perspective view of an arched frame and shutter of an inside window mount arched shutter according to another preferred embodiment of the present invention.

FIG. 24 is a perspective view illustrating a Z-mount arched frame 250 and arched shutter 252 of an inside-window-mount arched shutter 254 according to another preferred embodiment of the present invention. The inside-window-mount arched shutter 254 utilizes a Z-type molding 255 as shown in FIG. 26. FIG. 26 illustrates the Z-type molding 255, as it would be used for the bottom portion 259, and side portions 258 and 260. The problem with this prior art molding is that this type of molding cannot be used to make the arched portion 256 of the frame 250. In the past, the arched portion 262 was made using a solid slab of wood. The slab of wood was cut in an arch (using a similar method to that illustrated in FIG. 20). The wood arch was then sawed by hand to remove the portion necessary to be removed to allow the inside-window-mount arched shutter 254 to be fitted against the wall 257 and inside ceiling 257' of the window niche (not shown) as shown in FIG. 26. The old sawing procedure left the arched portion 256 uneven and used additional labor and time that the improved version does not (embodying herein whereby the difficulties of cutting an approximate arched Z-shape from a single arched blank of wood are reduced).

FIG. 27 illustrates, in section, the preferred embodiment of the arched portion 256 comprising arched face frame portion 264, frame portion 266 and light stop 268, as shown. Preferably, as illustrated and discussed above in reference to FIG. 20 through FIG. 22 two arched portion face frames 264 and 270 are made from a singular pattern 208. Preferably, arched portion face frame 264 is used for the Z-mount arched frame 250 (embodying herein using such second arch-shaped piece in the manufacture of an upper portion of a Z-mount arched shutter outer frame) and arched portion face frame 270 is used for arched shutter 252 (embodying herein using such third arch-shaped piece in the manufacture of a Z-mount arched shutter inner frame).

Figure 25:
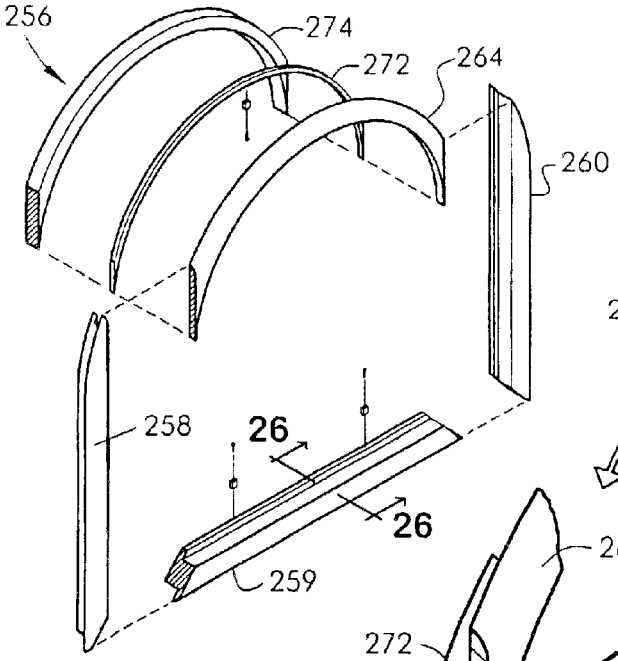
FIG. 25 is an exploded view of the arched frame of FIG. 24.
Figure 28:
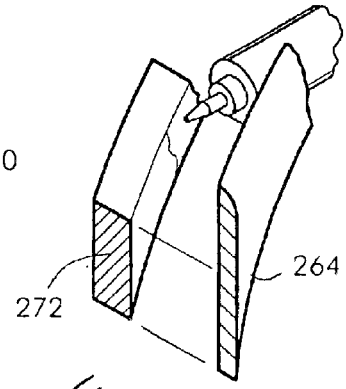
FIG. 28 is a perspective view, partially in section, illustrating steps in a method of making the arched frame of FIG. 25 according to another preferred embodiment of the present invention.
Figure 29:
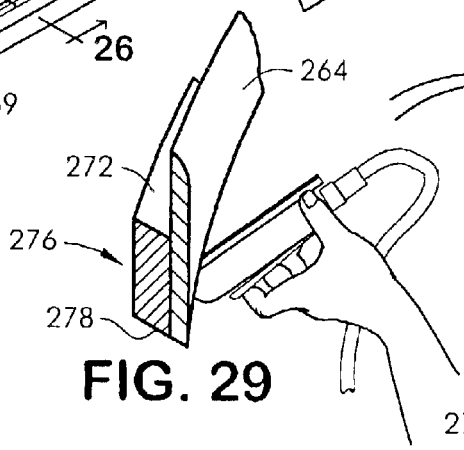
FIG. 29 is a perspective view, partially in section, illustrating further steps in a method of making the arched frame of FIG. 25.

FIG. 25 is an exploded view of the arched frame 250 of FIG. 24. Preferably, arched portion 256 comprises arched face frame portion 264, frame portion 266 and light stop 268. The improvement, in combination with the shutter system 120, provides a method for making the arched portion 256 from three separate pieces (embodying herein assembling by attachment a three-part arched portion of such Z-mount arched shutter outer frame; wherein a first part comprises such second arch-shaped piece, a second part comprises a lower height (than such first part) arch-shaped spacer mounted to the rear of such first part, such second part having such second inner radius, a third part comprises an arch-shaped light blocking element mounted to the rear and below such second part, such assembled three-part arched portion comprises an approximate Z-shape). Preferably, arched portion face frame 264 is attached to a framing member 272, preferably by gluing, as illustrated in FIG. 28. Preferably, framing member 272 is sized to a depth that will allow the shutter portion to fit within the arched frame 250, as shown in FIG. 27.

Figure 30:
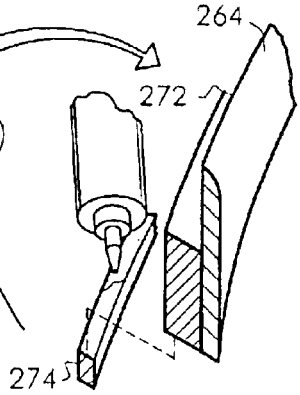
FIG. 30 is a perspective view, partially in section, illustrating yet further steps in a method of making the arched frame of FIG. 25.

Preferably, after attaching framing member 272 to the face frame 264, the assembly 276 is sanded such that the bottom 278 portion of the two mated pieces, framing member 272 and face frame 264, are smoothed. Preferably, as illustrated in FIG. 30, the light stop 274 is attached, again preferably by gluing to the assembly 276, as shown. Finally, the arched portion 256 is attached to the bottom portion 259, and side portions 258 and 260, creating the arched frame 250.

Preferably, the shutter system 120 comprises a resistance system 280, which assists in maintaining an angular position of the louvers 136 after the louvers 136 have been positioned by a user. Three embodiments of such resistance system 280 are now described in reference to FIG. 31, FIG. 32, FIG. 33*a*, FIG. 33*b* and FIG. 33*c*.

Figure 31:
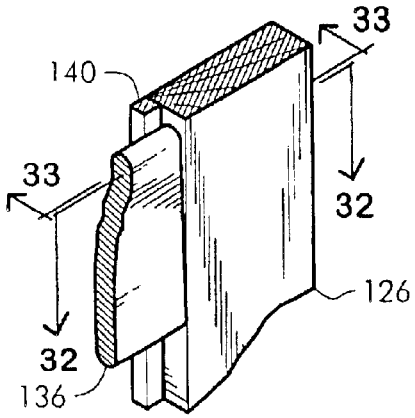
FIG. 31 is a perspective view, partially in section, of a section of louver and stile according to a preferred embodiment of the present invention.
Figure 32:
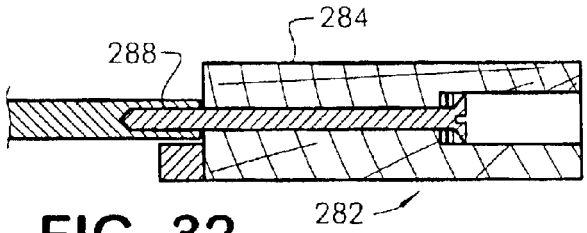
FIG. 32 is a sectional view through section 32—32 of FIG. 31.

FIG. 31 is a perspective view, partially in section, of a section of louver 136 and stile 128 utilizing a resistance system 280, according to a preferred embodiment of the present invention. FIG. 32 is a sectional view through section 32—32 of FIG. 31. FIG. 32 illustrates a prior art embodiment 282 for resistance systems 280, as shown. In the illustrated embodiment 282, a screw 284 is used as a louver-resister 280, as shown. Typically, a screw 284 used in such manner only provides a minimal degree of resistance as the screw 284 is tightened down. The friction or tension in such use is limited to the strength of the louver material 286 (typically wood) in the louver 136 and the ability of such material 286 to hold the tension of the screw threads 288 as they are tightened into the louver 136, without stripping, which would cause the screw 284 to come loose, thereby allowing the louvers 136 to free-fall when set and most likely close shut. Typically, the screw used is a two and one-half inch sheetrock-screw with fine threads. Under appropriate circumstances, other arrangements may suffice. For example, a smaller length screw may suffice or a screw with courser threads or another style of screw such as a wood screw.

Figure 33A:
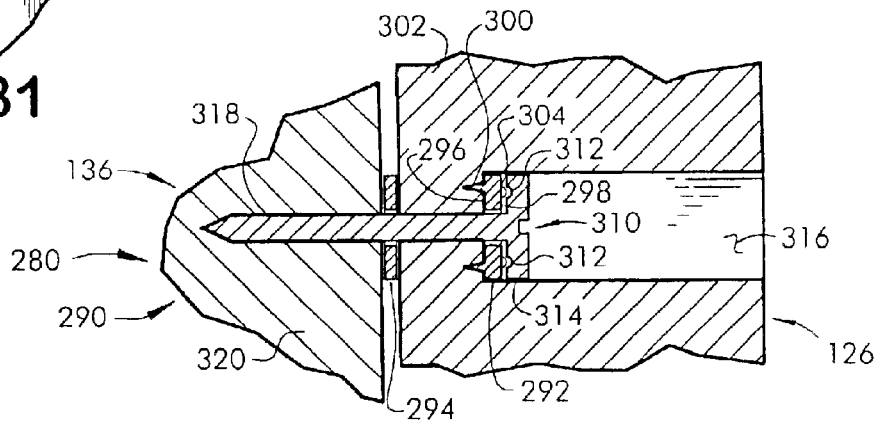
FIG. 33*a* is a sectional view through section 33—33 of FIG. 31.

FIG. 33*a* is a sectional view through section 33—33 of FIG. 31. Preferably, FIG. 33*a* illustrates embodiment 290 of a resistance systems 280 of the shutter system 120. Preferably, in this embodiment 290, the resistance system 280 comprises a first co-planar washer 292, a second co-planar washer 294 and a screw, as shown. Preferably, first co-planar washer 292 further comprising a first side 296 and a second side 298, as shown. Preferably, first side 296 comprising a plurality of holders 300, preferably pointed prongs that will penetrate the wood material 302 of the stiles 126 (or 128) such that the co-planar washer 292 is firmly held and will not twist or spin during usage. Preferably, the second side 296 comprises a plurality of tabs 304, as shown. Preferably, second co-planar washer 294 acts as a spacer between the stile 126 and the louver 136, as shown. Preferably, second co-planar washer 294 is a plastic washer, most preferably nylon or neoprene.

Preferably, screw 310 comprises an integral washer 314 comprising a plurality of indentations 312, as shown. Preferably, indentations 312 are structured and arranged such that a respective tab 304 will slidably lock into a respective indentation 312 when so placed. Under appropriate circumstances, other arrangements may suffice (for example the indentations 312 could be on the washer and the tabs on the screw). Preferably, screw 310 is placed through a pre-drilled hole 316 in the stile 126 and attached through a smaller pre-drilled hole 318 (preferably slightly smaller than the screw 310 to assist avoiding the wood 320 in the louver 136 to crack), as shown. Preferably, the screw 310 is installed by inserting the screw 310 through respective pre-drilled holes 316 and 318 through each respective first and second co-planer washers 292 and 294 and into the louver 136, as shown.

Figure 33B:
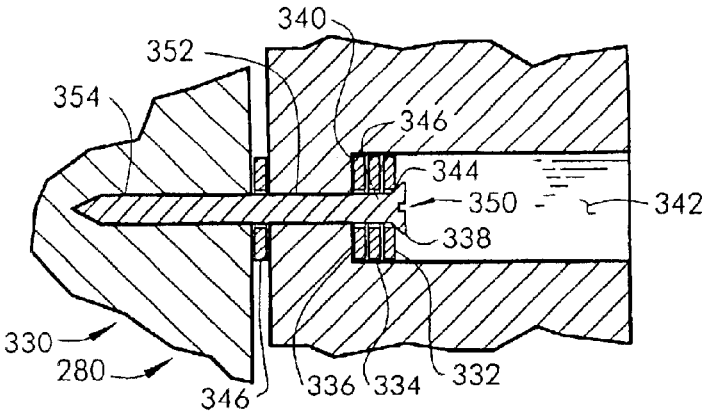
FIG. 33*b* is a sectional view through section 33—33 of FIG. 31.

Preferably, as the louvers are positioned by a user, the screw 310 turns slightly until the tab 304 engages one of the indentations 312 nearest the tab 302 thereby slidably locking into a respective indentation 312 of the louver 136 and assists in maintaining the louver 136 in a user-selected position FIG. 33*b* is a sectional view through section 33—33 of FIG. 31 illustrating embodiment 330, a resistance systems 280 of the according to another embodiment of the present invention. Preferably, in this embodiment 330, the resistance system 280 comprises a set of three washers 332, 334 and 336, installed adjacent each other in a line held tightly between the screw head 338 and the end 340 of the stile recess 342, as shown. Preferably, each respective washer 332, 334 and 336 comprises a central aperture 344 which the screw threads 346 may pass through and the screw head 338 may not, as shown. Preferably, washer 332 is plastic. Preferably, washer 334 is neoprene. Preferably, washer 336 is plastic. Preferably, another washer 346 is placed between the stile 126 and the louver 136, as shown. Under appropriate circumstances, other arrangements may suffice. For example, more than one washer between the stile 126 and the louver 136 may suffice under appropriate circumstances. Preferably, the screw 350 is installed by inserting the screw 350 through stile recess 332 and each respective pre-drilled hole 352, in the stile 126 and pre-drilled hole 354, in the louver 136, and through each respective central aperture 344 of each respective washer 332, 334 and 336 and into the louver 136, as shown. Preferably, tightening the screw 350 against the washers provides a friction hold wherein when the louvers 136 are positioned by a user, the described friction of the washers against the screw assists in maintaining the louvers 136 in the desired position the user has selected.

Figure 33C:
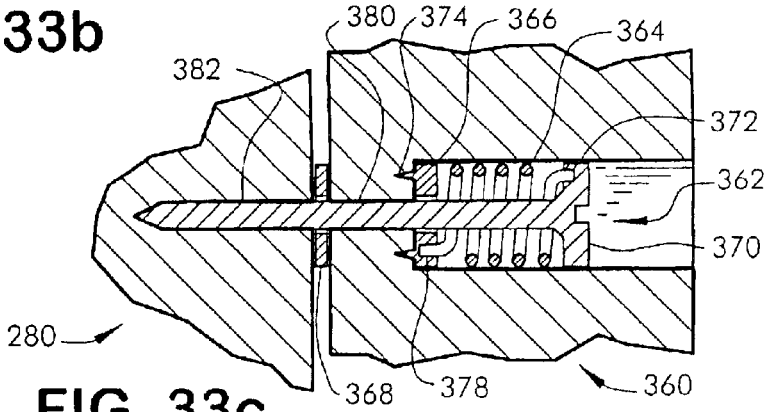
FIG. 33*c* is a sectional view through section 33—33 of FIG.

FIG. 33*c* is a sectional view through section 33—33 of FIG. 31 illustrating yet another cross-section view of a center-mounted resistor of the shutter system according to yet another embodiment of the present invention. Preferably, in this embodiment 360, the resistance system 280 comprises a screw 362, a spring 364, a spring retainer washer 366 and a spacer washer 368, as shown. Preferably, the screw 362 comprises a screw head 370 further comprising a spring retaining mechanism 372, preferably a notch, as shown. Preferably, one face of the spring retainer washer 366 further comprises a plurality of holders 300, preferably pointed prongs, similar to embodiment 290, that will penetrate the wood material and hold the spring retainer washer 366 in place. Preferably, the opposing face comprises a spring retaining notch 378, as shown. Preferably, the spring retainer washer 366 is inserted through a pre-drilled recess 374 as shown, preferably about three-eights of an inch in diameter. Preferably, the spring 364 is inserted and the screw is installed through each respective spring and washer into pre-drilled holes 380 and 382, as shown. Preferably, a spacer washer 384 is placed between the stile 126 and the louver 136, as shown. Preferably, as similarly stated above, tightening the screw 362 against the spring provides a tension wherein when the louvers 136 are positioned by a user, the described spring tension against the screw 362 assists keeping the louvers 136 in the desired position the user has selected.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A shutter system for controlling entry of outside light into a building comprising:

a) louver means for selectively regulating entry of the light into the building;

b) wherein said louver means comprises a plurality of slats, each said slat comprising i) a pair of longitudinal edges, ii) at least one slat end portion, each said slat end portion having a transverse edge, iii) pivoting means for pivoting said slat between an on open and closed position, iv) wherein said pivoting means is located adjacent one of said pair of longitudinal edges;

c) frame means for positionally supporting said louver means;

d) wherein said frame means comprises i) at least one outside peripheral frame edge, ii) at least one inside peripheral frame edge, iii) a hollow middle area substantially equal in size to an area of light regulation by said slats of said louver means, iv) a first face lying substantially in a first plane, and v) a second face opposing said first face and lying substantially in a second plane substantially parallel to said first plane;

e) locating means for locating said louver means so that i) at least one said transverse edge is adjacent said at least one inside peripheral frame edge of said frame means, and ii) no said longitudinal edges at said slat end portions extend beyond about said plane of said first face of said frame means when said plurality of slats are in the fully open position; and f) blocking means for blocking substantially all the entry of the light between said louver means and said frame means adjacent each said slat end portion adjacent said at least one inside peripheral frame edge;

g) wherein said first face of said frame means comprises said blocking means;

h) wherein said blocking means is fixedly attached along said at least one inside peripheral frame edge adjacent each of said slat end portions; and i) wherein said blocking means extends inwardly from said at least one inside peripheral frame edge toward said hollow middle area.

2. The system according to claim 1 further comprising:

a) tilt rod means for operating said louver means;

b) staple means for using staples to connect said tilt rod means to said louver means;

c) wherein said staple means comprises i) at least one first staple penetrating at least one said slat of said louver means, and ii) at least one second staple penetrating said tilt rod means, iii) wherein penetration of said slat by said first staple is about one inch, and iv) wherein penetration of said tilt rod means by said second staple is about one inch;

d) wherein said first and second staples comprise a pivotable interlocking attachment between said first and second staples.

3. The system according to claim 1 wherein said blocking means comprises a rectangular-cross-section rod.

4. The system according to claim 1 wherein said frame means comprises at least two stiles of approximately equal shape and at least two rails of approximately equal shape.

5. The system according to claim 1 wherein:

a) said blocking means comprises a rectangular-cross-section rod; and b) said frame means comprises at least two stiles of approximately equal shape and at least two rails of approximately equal shape.

6. A shutter system for controlling entry of outside light into a building comprising:

a) a shutter structured and arranged to regulate entry of the light into the building;

b) wherein said shutter comprises a plurality of slats, each said slat comprising i) a pair of longitudinal edges, ii) at least one slat end portion, each said slat end portion having a transverse edge, iii) at least one pivot adapted to permit pivoting said slat between an open and closed position, iv) wherein said at least one pivot is located adjacent one of said pair of longitudinal edges;

c) a shutter frame structured and arranged to positionally support said shutter;

d) wherein said shutter frame comprises
   i) at least one outside peripheral frame edge,
   ii) at least one inside peripheral frame edge,
   iii) a hollow middle area substantially equal in size to an area of light regulation by said slats of said shutter,
   iv) a first face lying substantially in a first plane, and
   v) a second face opposing said first face and lying substantially in a second plane substantially parallel to said first plane;

c) said shutter and said shutter frame being structured and arranged to provide that
   i) at least one said transverse edge is adjacent said at least one inside peripheral frame edge of said shutter frame, and
   ii) no said longitudinal edges at said slat end portions extend beyond about said plane of said first face of said shutter frame when said plurality of slat are in the open position; and f) a light blocker structured and arranged to block substantially all the entry of the light between said plurality of slats and said shutter frame adjacent each said slat end portion adjacent said at least one inside peripheral frame edge;

g) wherein said first face of said shutter frame comprises said blocker; and h) wherein said blocker is fixedly attached along said at least one inside peripheral frame edge adjacent each of said slat end portions; and i) wherein said blocker extends inwardly from said at least one inside peripheral frame edge toward said hollow middle area.

7. The system according to claim 6 further comprising:

a) a tilt rod structured and arranged to operate said shutter;

b) staples structured and arranged to connect said tilt rod to said shutter,
   i) at least one first staple penetrating at least one said slat of said shutter, and
   ii) at least one second staple penetrating said tilt rod,
   iii) wherein penetration of said slat by said first staple is about one inch, and
   iv) wherein penetration of said tilt rod by said second staple is about one inch;

c) wherein said first and second staples comprise a pivotable interlocking attachment between said first and second staples.

8. The system according to claim 7 further comprising a resistance system for maintaining said tilt rod in a user-selected position.

9. The system according to claim 6 wherein said blocker comprises a rectangular-cross-section rod.

10. The system according to claim 6 wherein said shutter frame comprises at least two stiles of approximately equal shape and at least two rails of approximately equal shape.

11. The system according to claim 6 wherein:

a) said blocker comprises a rectangular-cross-section rod; and b) said shutter frame comprises at least two stiles of approximately equal shape and at least two rails of approximately equal shape.

* * * * *

UNITED STATES PATENT AND TRADEMARK OFFICE

CERTIFICATE OF CORRECTION

PATENT NO. : 6,810,619 B2
DATED : November 2, 2004
INVENTOR(S) : Wilson, Ronald J.

It is certified that error appears in the above-identified patent and that said Letters Patent is hereby corrected as shown below:

Column 17,
Line 56, “an on open” should read -- an open --

Column 19,
Line 11, “c)” should read -- e) --
Line 18, “slat” should read -- slats --

Signed and Sealed this

Fifteenth Day of February, 2005

JON W. DUDAS
*Director of the United States Patent and Trademark Office*